United States Patent [19]

Marozzi et al.

[11] Patent Number: 4,760,788

[45] Date of Patent: Aug. 2, 1988

[54] RECIPROCATING PRINT HEAD MARKING APPARATUS

[75] Inventors: Alfred A. Marozzi, 444 William St., East Orange, N.J. 07017; Thomas A. Sapinski, Rochelle Park, N.J.

[73] Assignee: Alfred A. Marozzi, Pine Brook, N.J.

[21] Appl. No.: 914,157

[22] Filed: Oct. 1, 1986

[51] Int. Cl.[4] ..... B41K 1/42

[52] U.S. Cl. ..... 101/333; 101/318

[58] Field of Search ..... 101/334, 301, 305, 310, 101/314, 315, 104, 105, 333, 318, 316, 320, 321, 324, 41–44

[56] References Cited

U.S. PATENT DOCUMENTS

| | | | |
|---|---|---|---|
| 3,635,154 | 1/1972 | Gery et al. | 101/334 X |
| 3,804,016 | 4/1974 | Marozzi et al. | 101/334 X |
| 4,015,525 | 4/1977 | Shenoha | 101/333 |
| 4,419,931 | 12/1983 | Siegal | 101/333 |

FOREIGN PATENT DOCUMENTS

| | | | |
|---|---|---|---|
| 0000211 | 1/1980 | Japan | 101/301 |

*Primary Examiner*—Clifford D. Crowder

*Attorney, Agent, or Firm*—Fleit, Jacobson, Cohn & Price

[57] ABSTRACT

An angularly orientated print head is displaced by a reciprocating power actuator from contact with a wet inking surface along a fixed travel path having acceleration and deceleration portion. A shock absorbing guide roller stabilizes the orientation of the print head as it approaches its marking position along the deceleration portion of the travel path. A drive mechanism between the actuator and the print head renders movement thereof to and from the marking position continuous for imprinting continuously moving target material.

14 Claims, 4 Drawing Sheets

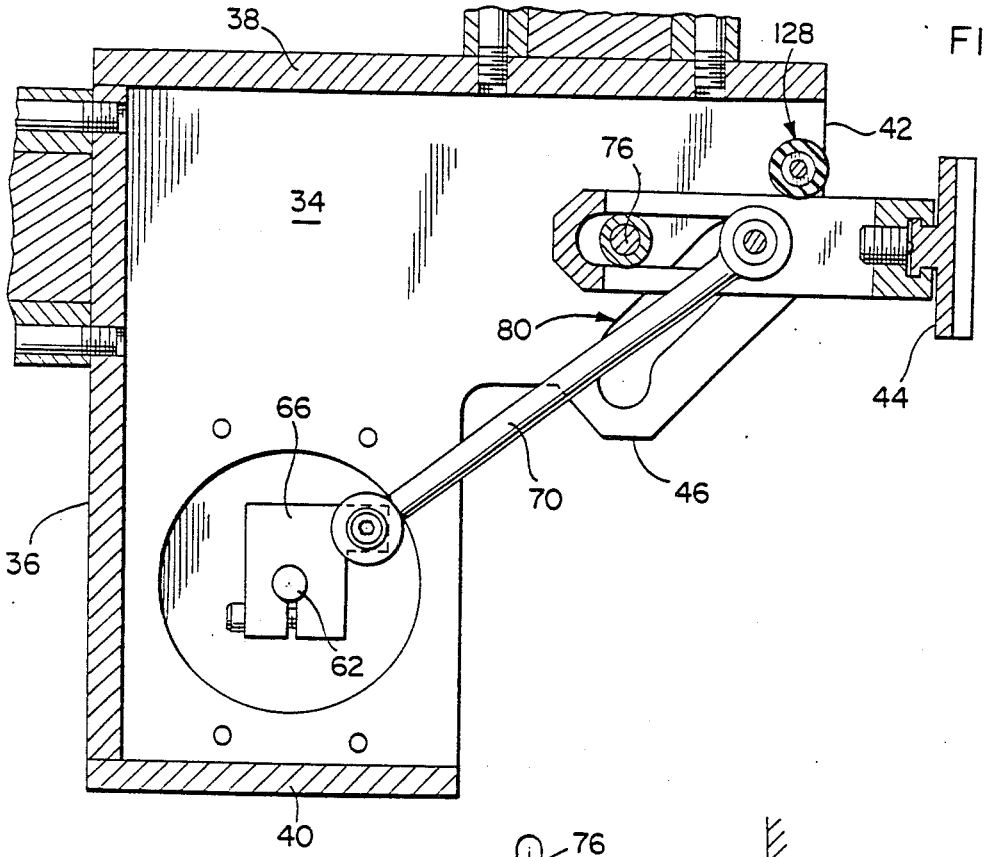
FIG. 4A
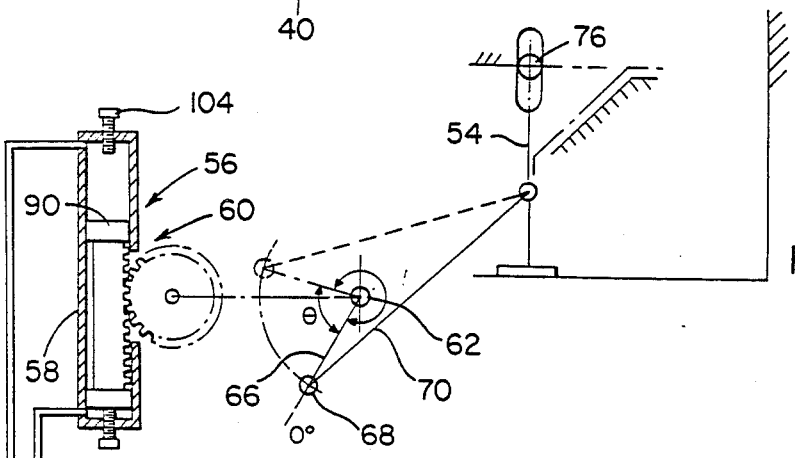
FIG. 5
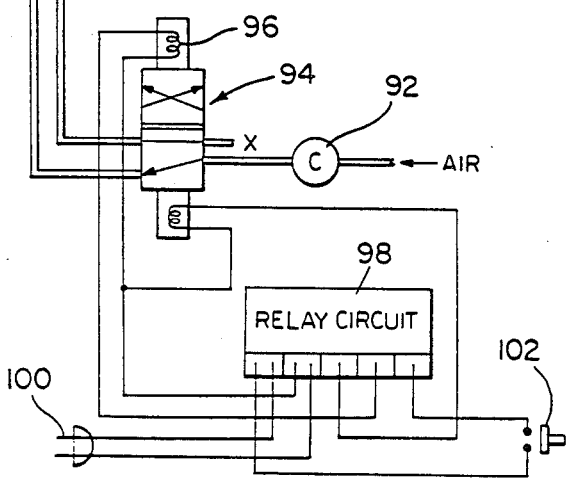
FIG. 5A
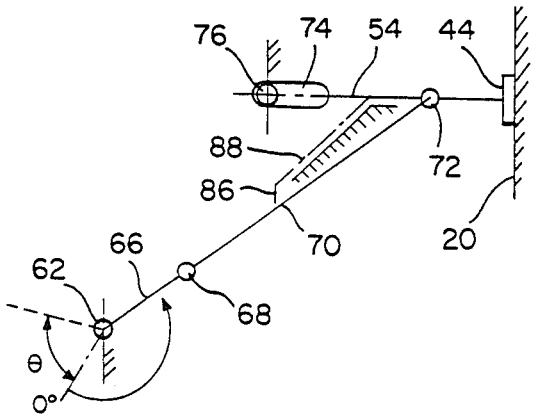

FIG. 7
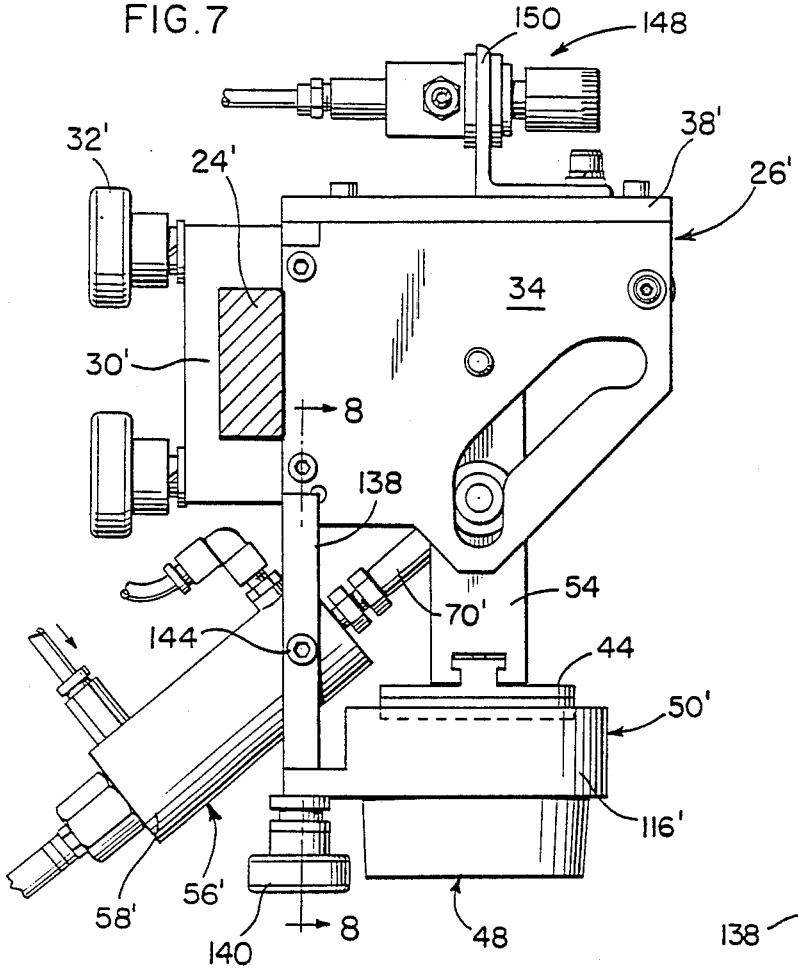
FIG. 6
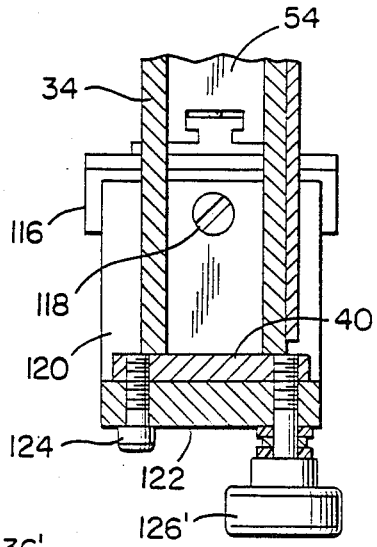
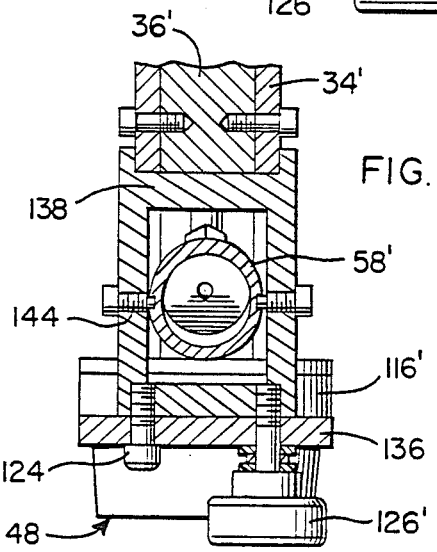
FIG. 8
FIG. 6A
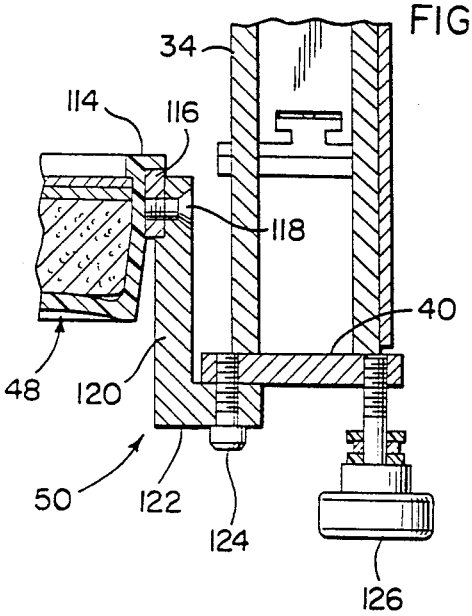
FIG. 9
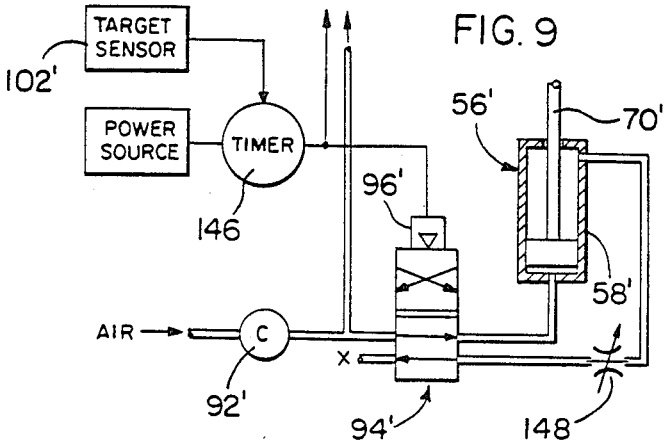

RECIPROCATING PRINT HEAD MARKING APPARATUS

BACKGROUND OF THE INVENTION

2. Field of the Invention

This invention relates to improvements in ink marking apparatus in general and to the print head operating mechanism, in particular of the type disclosed in prior U.S. Pat. No. 3,797,390, issued Mar. 19, 1974 and in presently pending U.S. application Ser. No. 254,396, filed Apr. 15, 1981 now U.S. Pat. No. 4,694,747.

According to prior U.S. Pat. No. 3,797,390, a print head is reciprocated between inking and marking positions by movement along a travel path established by a fixed cam track. During such movement, the print head is angularly reorientated for operative contact with a wet ink surface and a target on a work backing surface. Such arrangement was adopted and utilized in the marker apparatus disclosed in the more recent U.S. Pat. No. 4,528,908 to Davison et al. This same type of arrangement is also disclosed in the presently pending application aforementioned. The aforesaid type of ink marking apparatus has, however, been limited in use to imprinting on material undergoing intermittant travel, wherein print head contact occurs only while the material is momentarily stationary. For continuously moving target material, rotary print head arrangements have been developed as disclosed, for example, in prior U.S. Pat. No. 4,566,387. For such rotary print heads, inking rolls are utilized to indirectly transfer ink from a stationary ink storing cartridge in contrast to the direct transfer contact associated with the reciprocating and angularly reorientated type of print head aforementioned. Rotary print heads furthermore impose dimensional restrictions dependent on the diameter of the print cylinder and present problems in chaning type position.

It is therefore an important object of the present invention to provide an ink marking apparatus having the advantages associated with reciprocating and swingable print heads and yet having the flexibility of being adapted to the imprinting of continuously moving target material at rapid speeds.

Yet another object of the invention is to provide a marking device capable of being operatively installed with greater flexibility and less restriction, while providing easier access for both changing of the type and replacement of the ink storing cartridge.

SUMMARY OF THE INVENTION

In accordance with the present invention, the mounting frame of the ink marking apparatus supports a selectively pivoted ink cartridge holder through which the wet ink contact surface of the ink storing cartridge may be swung out of alignment with the print head in its inking position. The ink cartridge may thereby be replaced and the print head exposed for type changing purposes.

The print head is carried by a holder through which it is reciprocated along the travel path of the frame mounted cam tracks, between the inking and marking positions. The acceleration portion of the travel path is divided by the cam track configuration into an initial section and an intermediate section forming a major portion of the travel distance, such as 80%, during which the print head acquires its maximum velocity. It is during such travel along the intermediate section of the travel path that the print head is angularly reorientated about a frame fixed pivot slidably extending through a guide slot in the print head holder. Such angular reorientation is restricted to the intermediate acceleration section of the travel path because of the perpendicular relationship of the initial section and the deceleration portion of the travel path to the inking and work backing surfaces, respectively. During travel of the print head holder along the deceleration portion of the travel path, it is engaged by a shock absorbing roller guide to stabilize the print head orientation as it approaches the marking position.

Movement along the travel path is imparted to the print head holder by a reciprocating power actuator through a connecting rod to which the holder is pivotally connected at one end by a connecting pin. According to one embodiment of the invention the other end of the connecting rod is pivotally connected to a harmonic drive mechanism driven by a reciprocating power actuator. The drive mechanism includes a crank arm undergoing rotation through an angular stroke of less than 360° to complete one operational cycle during which the print head travels with continuous motion from its inking position at rest to the marking position and returns to the inking position. Halfway through such cycle of the harmonic drive mechanism, the print head contacts the target "the fly" or while the crank arm is continuously moving at a high velocity. Such harmonic drive mechanism in conjunction with the travel path to which movement of the print head is constrained establishes the travel conditions, heretofore deemed unattainable with non-rotary print heads, for imprinting of continuously moving target material indefinitely without readjustment.

According to another embodiment, the connecting rod aforementioned extends directly from the piston of a pivotally mounted cylinder of a fluid type reciprocating power actuator. Fluid flow may be adjusted through a needle valve associated with this embodiment in order to compensate for differences between a plurality of marking devices being simultaneously supplied with pressurized fluid from a common source. Further, in this embodiment, the duration of each operational cycle may be adjusted through a timer to approach print head travel conditions enabling the imprinting of continuously moving target material.

These together with other objects and advantages which will become subsequently apparent reside in the details of construction and operation as more fully hereinafter described and claimed, reference being had to the accompanying drawings forming a part hereof, wherein line numerals refer to like parts throughout.

BRIEF DESCRIPTION OF DRAWING FIGURES

FIG. 4A is a view similar to FIG. 4, but corresponding to FIG. 3A.

FIG. 5 is a schematic illlustration of the linkage and a simplified control system associated with the apparatus shown in FIGS. 1–4.

FIG. 5A illustrates the linkage portion of FIG. 5 in a phase position corresponding to FIGS. 3A and 4A.

FIG. 6 is an enlarged partial section view taken substantially through a plane indicated by section line 6—6 in FIG. 1.

FIG. 6A is a section view similar to that of FIG. 6 showing the ink cartridge displaced to an inoperative position.

FIG. 7 is a side elevation view of another embodiment of the marking apparatus.

FIG. 8 is an enlarged partial section view taken substantially through a plane indicated by section line 8—8 in FIG. 7.

FIG. 9 is a schematic illustration of a simplified control system associated with the embodiment of FIGS. 7 and 8.

DETAILED DESCRIPTION OF PREFERRED EMBODIMENTS

Figure 1:
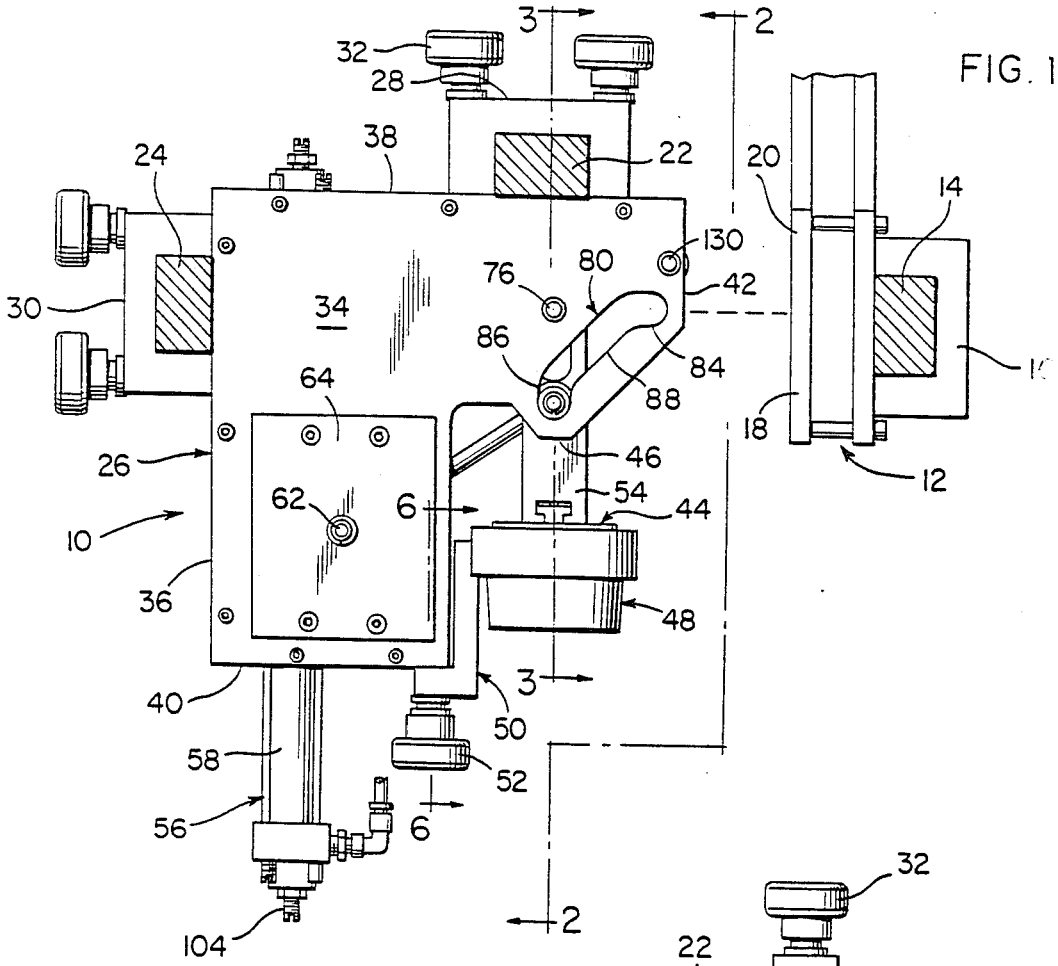
FIG. 1 is a side elevation view of an ink marking apparatus in accordance with one embodiment of the invention.
Figure 2:
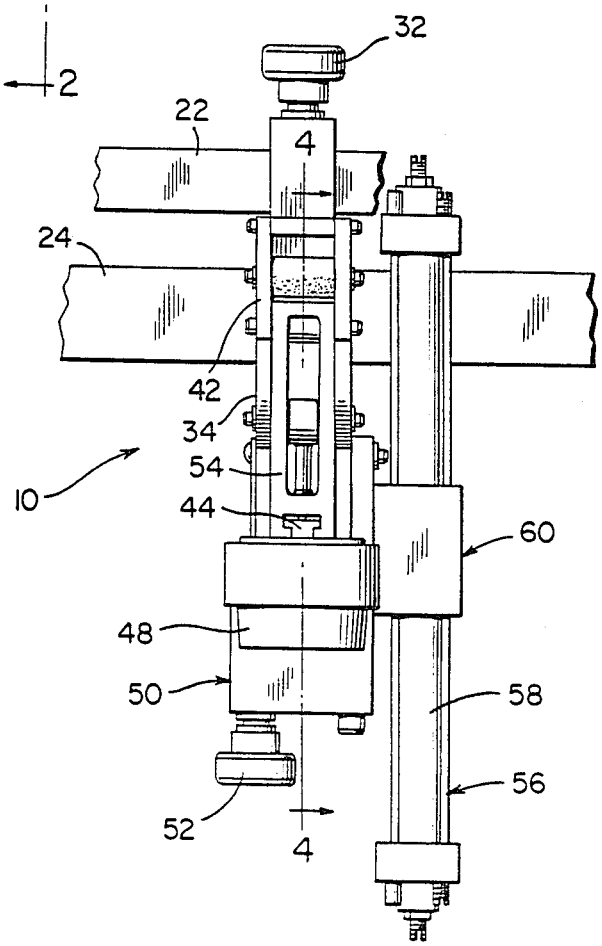
FIG. 2 is an end view of the apparatus as viewed from a plane indicated by section line 2—2 in FIG. 1.

Referring now to the drawings in detail, FIGS. 1 and 2 illustrate an ink marking apparatus in accordance with one embodiment of the invention, generally referred to by reference 10. The apparatus 10 is mounted in fixed operative relationship to a work supporting platen assembly 12 mounted by way of example on a beam 14 by means of a clamp 16. The platen assembly thereby fixedly positions a work or target backing anvil member 18 having a work or target backing surface 20 along which targets are formed by way of example on a packaging film web. The marking apparatus 10 is positioned in close space relationship to the backing surface 20 of the anvil 18 by means of a pair of supporting beams 22 and 24 to which a frame assembly 26 of the apparatus is secured by clamps 28 and 30. The frame assembly 26 is slideably adjustable along the support beams 22 and 24 and locked in adjusted position by means of the lock screw knobs 32 associated with the clamps 28 and 30. It should of course be appreciated that other adjustable mounting arrangements could be utilized to positon the apparatus frame assembly 26 in operative relationship to the work backing platen assembly 12.

The frame assembly 26 is formed by parallel spaced side plates 34 interconnected by a base plate 36 and front and back plates 38 and 40 extending at right angles from the base plate 36. The side plates 34 of the frame assembly have edge sections 42 exposed in parallel spaced relationship to the backing surface 20 of the anvil member 18 from which a print head 44 is projected towards the work backing surface 20 as will be described hereinafter. In the inking position shown in FIGS. 1 and 2, the print head 44 projects from a convergent edge portion 46 of the side plates 34 in parallel spaced relationship to the work backing surface 20 so as to contact an ink storing cartridge 48. The ink storing cartridge is operatively positioned for contact by the print head by means of a holder generally referred to by reference numeral 50 releasably locked to the frame assembly 26 by means of a lock screw knob 52.

The print head or type mounting pad 44 is carried at one longitudinal end of an elongated holder or carrier 54 to which movement is imparted through a predetermined stroke by means of an air-pressure powered actuator generally referred to by reference number 56. The actuator is in the form of an elongated air pressure cylinder 58 within which a slideably piston is displaced through a predetermined stroke during each half cycle as will be explained in detail hereinafter. The cylinder enclosed piston is drivingly connected to gear means 60 from which the air cylinder 58 extends as shown in FIG. 2. A continuous rotational input from the powered actuator 56 is converted into reciprocating movement of the print head holder 54 in the embodiment illustrated in FIGS. 1 through 6 by means of a drive mechanism described in detail hereinafter.

Figure 3A:
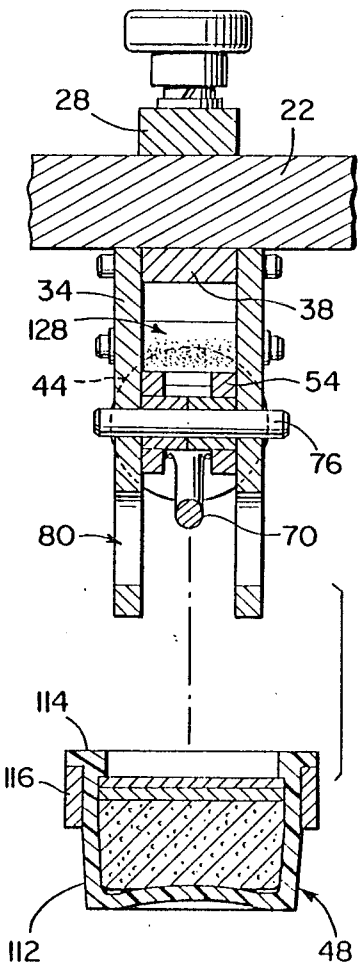
FIG. 3A is a view similar to FIG. 3 showing the print head in its marking position.
Figure 3:
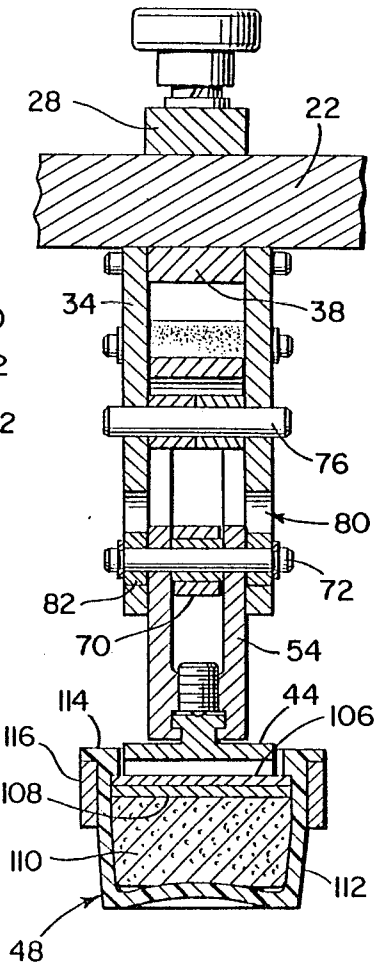
FIG. 3 is an enlarged section view taken substantially through a plane indicated by section line 3—3 in FIG. 1.
Figure 4:
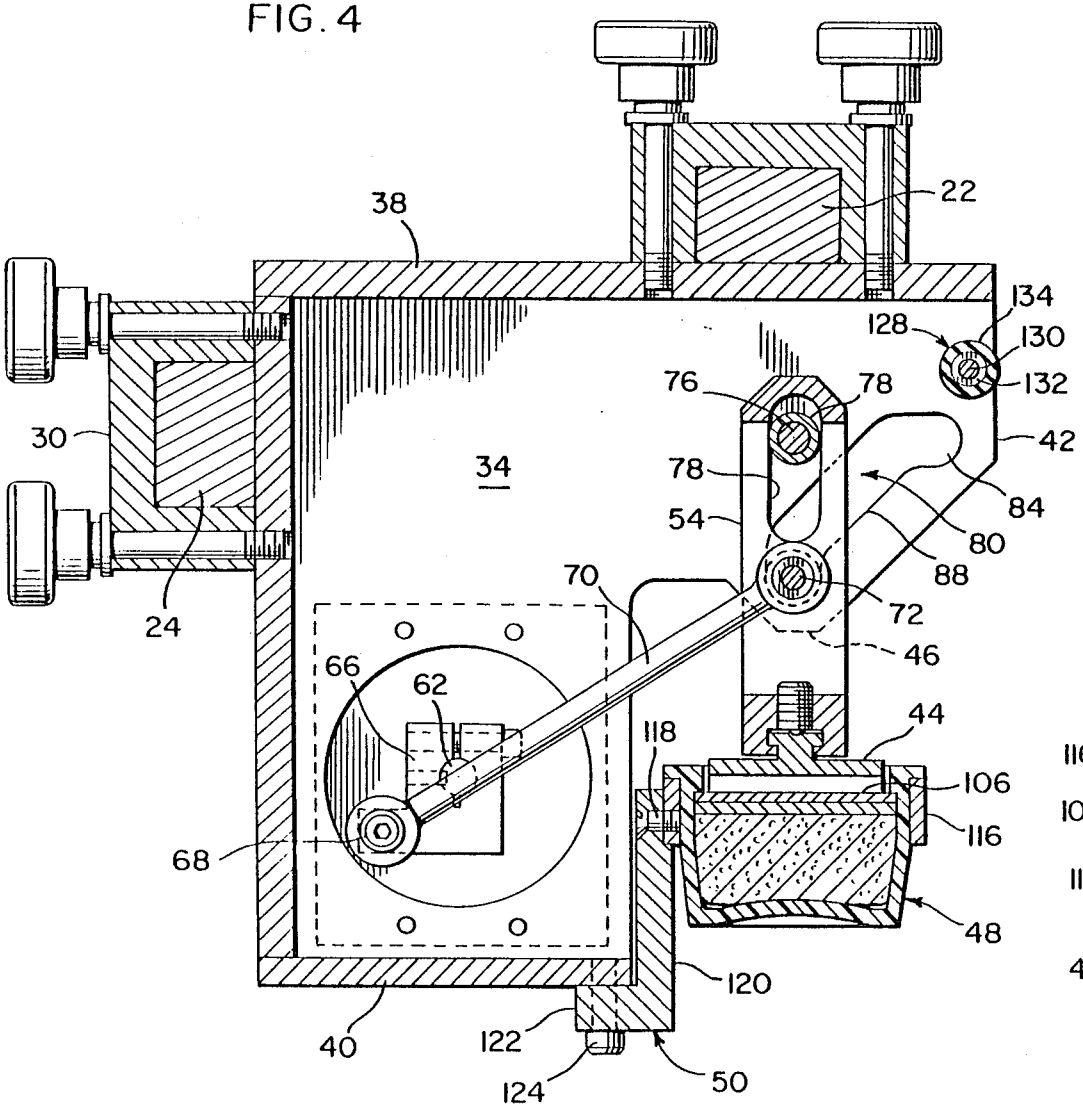
FIG. 4 is an enlarged section view taken substantially through a plane indicated by section line 4—4 in FIG. 2.

As more clearly seen in FIGS. 3 and 4, the rotational input from the gearing 60 of the powered actuator 56 is applied through an input shaft 62 journalled by means of a bearing plate 64. The input shaft 62 as shown in FIG. 4 is connected to a crank arm 66. The crank is connected by means of a crank pin 68 to one longitudinal end of a force transmitting link in the form of a connecting rod 70, the other end of the link 70 being pivotally connected by a connecting pin 72 to the print head holder 54. The print head holder is provided with a slot 74 through which a pivot pin 76 extends. The pivot pin is fixed at its opposite axial ends to the side plates 34 and is provided with a bearing bushing 78 in slideable contact with the sides of the slot 74 in the print head holder. Thus, the print head holder will be both pivotally and slideably displaced relative to the frame assembly in response to displacement of the connecting pin 72 by the powered actuator through the force transmitting link or connecting rod 70.

The connecting pin 72 is constrained to a travel path established by a cam track slot configuration 80 formed in the side plates 34 of the frame assembly. The connecting pin is journalled within the end of the connected rod 70 and extends axially into bearing bushings 82 within the cam slots of the cam track 80 as more clearly seen in FIG. 3 so as to form a cam follower constraining movement of the connected pin 72 to the predetermined path of travel. The cam slots of the track 80 include at one terminal end a deceleration portion 84 along which the velocity of the pin 72 is reduced as it approaches the target on a path generally perpendicular to the work backing surface 20. The remainder of the cam slots form an acceleration portion of the travel path which includes a terminal end section 86 which extends generally perpendicular to a wet ink contacting surface of the ink cartridge 48 which is perpendicular to surface 20. The terminal end section 86 forms a section along which pin 72 is accelerated to a predetermined velocity, at an angle to an intermediate path section 88 of the cam track along which the pin is accelerated to a different velocity. Thus, the cam track configuration 80 is such as to divde the acceleration portion thereof into section 86 and 88 which form the major portion of the travel path, such as 80% as compared to 6% for the deceleration portion 84.

FIG. 5 kinematically illustrates the motion converting linkage system formed by the print head holder 54 and the connecting rod 70 driven by a harmonic drive mechanism formed by the crank arm 66 to which a rotating input is applied from the gearing 60 shown to be in the form of a rack and pinion. Piston elements 90 of the power actuator 56 connected to opposite ends of the gearing rack undergo a complete conventional reciprocating stroke in one direction in order to effect one operational cycle by imparting rotation to the input shaft 62 through an angle of $360° - \theta$, where $\theta$ is less than 180°. At the beginning of one operational cycle, the crank arm 66 will be at its starting position as shown in FIGS. 4 and 5 with the connecting rod 70 holding the print head holder 54 at rest in its inking position. As the input shaft 62 is rotated, the cam follower 72 is accelerated at a relatively slow rate along the section 86 of the travel path because of its geometrical relationship to the drive mechanism for a short distance effecting displacement of the print head holder 54 guided by the slot 74 and fixed pivot 76 causing the print head 44 to be withdrawn from the wet inking surface of the ink storing cartridge 48. The cam follower connecting pin 72 is then advanced at a higher acceleration along the section 88 of the travel path because of its different angular relationship to the harmonic drive and the phase of its harmonic motion . The print head holder will accordingly be slideably displaced and angularly displaced relative to the pivot pin 76 until the cam follower conecting pin 72 reaches the deceleration portion 84 of the travel path. The print head holder 74 will then be advanced to the end of its stroke along the deceleration portion 84 of the travel path as shown in FIG. 5A until the marking position of the print head 44 is reached. The marking position corresponds to the mid stroke position of the power actuator 56 corresponding to rotation of the crank arm 66 by $(180°-\theta/2)$. Because of such mid-stroke phase relationship between the crank arm 66 and the marking position of the print head, any over-center locking tendency is avoided. As the power actuator completes the second half of its stroke the crank arm 66 completes its angular stroke of $(360°-\theta)$ returning the print head 44 to its initial inking position as shown in FIG. 5. The crank arm 66 undergoes the same angular stroke in the opposite direction during the next operational cycle. An angle $\theta$ of approximately 20° has been found to be suitable in accomodating printing speeds up to 400 prints per minute.

FIG. 5 schematically shows a typical control system through which the power actuator 56 is operated as hereinbefore described for marking targets either on continuously moving webs or intermittently moving webs displaced along the work backing surface 20. A source of pressurized air such as compressor 92 may be fed to opposite ends of the piston cylinder 58 through a suitable control valve 94 that is displaced in opposite directions by means of solenoids 96. The solenoids are connected to a relay circuit 98 through which they are controllably energized from any suitable electrical power source at 100. A work contact sensor 102 controls operation of the relay circuit 98 in a manner well known in the art in order to effect reciprocating operation of a piston assembly formed by Pistons 90 interconnected by the gearing rack within the power actuator cylinder 58. The piston assembly stroke may be adjusted at opposite ends by limit screws 104. The stroke limiting screws 104 will determine the depth to which the print head enters the ink cartridge 48 as it approaches its inking position.

In the inking position of the print head holder 54, the print head 44 engages a wet inking surface within the ink storing cartridge 48 formed on a Teflon cover 106 in the illustrated embodiment as shown in FIGS. 3 and 4. In the illustrated embodiment, the inking surface and backing surface 20 are aligned with contact planes at right angles to each other. The cover 106 is secured to a felt pad 108 through which the flow of ink is regulated from an ink storing foam body 110 enclosed within a relatively rigid housing container 112. The housing container 112 is held in its operative position as shown by means of its flange 114 at its open end seated on an annular element 116 of the cartridge holder 50. The annular element 116 is secured by a fastener 118 to a mounting plate 120 as shown in FIGS. 4 and 6. A mounting base 122 extends at right angles from the mounting plate 120. The base portion 122 of the cartridge holder is pivotally connected to the plate 40 of the housing assembly by means of a pivot connector 124. The cartridge holder 50 is releasably locked in the operative position shown in FIGS. 4 and 6 holding the ink cartridge 48 in operative alignment with the print head holder in its inking position by means of a lock screw knob 126. By releasing the lock screw knob 126, the holder 50 and ink cartridge may be pivoted out of operative position as shown in FIG. 6A in order to permit replacement of the ink cartridge and/or repair of any other parts of the marking apparatus.

An important improvement embodied in the marking apparatus of the present invention involves stabilization of the print head during approach to its marking position. Toward that end, a shock absorbing guide roller assembly 128 is mounted between the side plates 34 of the frame assembly adjacent the edge portions 42 as shown in FIGS. 4 and 4A. The shock absorbing guide assembly includes a roller pin 130 on which a bushing 132 is mounted between the side plates. A shock absorbing cylindrical element 134 made of a suitable material such as rubber is mounted on the bushing.

The shock absorbing guide roller is operatively mounted adjacent the edges 42 of the side plates between the decelerating portion 84 of the cam track and the top plate 38 so as to be engaged by the print head holder 54 in its horizontal position as shown in FIG. 4A during its deceleration phase of travel to the marking position.

FIGS. 7, 8 and 9 illustrate another embodiment of the invention which is similar to the embodiment hereinbefore described except for the power actuator drive arrangement. As shown in FIG. 7, the marking apparatus includes a similar type of frame assembly 26' mounted in operative position on a support beam 24 by a clamp 30'. The frame assembly is releasably locked in an adjusted position relative to the target support by lock screw knobs 32'. Also, the print head 44 is carried by a holder 54 as hereinbefore described, shown in its inking position in FIG. 7 engaging a wet inking surface within the ink storing cartridge 48. A cartridge holder 50' is utilized to hold the cartridge in its operative position and includes an annular portion 116' from which a mounting arm 136 extends. A support section 138 is secured to the base portion of the frame assembly 26' and depends therefrom as shown for support of the cartridge holder 50' through its mounting arm 136. The mounting arm 136 is pivotally connected to the support section by a pivot screw 124' and releasably locked in its operative position by means of a lock screw knob 126'. It will be apparent that the ink cartridge 48 may be swung out of position by means of its holder 50' by loosening of the lock screw knob 126' in a manner similar to that described with respect to FIGS. 6 and 6A.

The print head 44 is displaced from its inking position with the holder 54 to the marking position by means of a force transmitting connected rod 70' in a manner similar to that hereinbefore described with respect to FIGS. 1 through 6. However, the force transmitting ink 70' constitutes a piston rod extending from a double action piston element 142 slideable within the cylinder 58' of the power actuator 56' as schematically shown in FIG. 9. The cylinder 56' as shown in FIGS. 7 and 8 is pivotally mounted within the frame support section 136 by means of pivot extensions 144.

Referring once again to FIG. 9, operation of the piston type power actuator 56', by way of example, may be effected by supply of pressurized air to opposite ends of the cylinder 58' through a suitable control valve 94' operated by means of a solenoid 96' under control of a timer 146. The timer 146 may be utilized to adjust the duration of an operational cycle during which movement of a web on the work backing surface is either continuous or the web is temporarily halted. Pressurized air for operating the power operator is derived from a compressor 92' connected to the control valve 94'. The adjustable needle valve 148 is placed in one of the control lines from the valve 94'. By means of the needle valve 148, the inflow and outflow of pressurized air to one end of cylinder 58' may be adjusted when multiple marking devices are utilized together. Also, the output of the timer 146 may be applied to a plurality of separate power actuators respectively associated with such plurality of marking apparatuses. Operation of each marking apparatus may be fine tuned by means of its adjustable needle valve 148 to compensate for minor differences in parts, tolerance and air distribution. The timer 146 will be triggered into operation in a manner well known in the art through some target sensor 102' to determine the duration of each operational cycle. Except for the lack of any harmonic drive connection, the marking apparatus described with resepct to FIGS. 7, 8 and 9 otherwise operates in substantially the same manner as hereinbefore described with respect to FIGS. 1–6. The needle valve 148 may be mounted on the top plate 38' of the frame assembly 26' by means of a bracket 150 as shown in FIG. 7.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is as follows:

1. In an apparatus for marking a target on a work surface, including a frame mounted in operative relation to the work surface, a powered actuator, an ink storing device having a wet inking surface positioned in predetermined spaced relation to the work surface, a print head alternatively engageable with said inking surface and a target on the work surface and a drive mechanism responsive to operation of the powered actuator for displacing and reorientating the print head between inking and marking positions respectively engaging the inking surface and the target, said drive mechanism having a force transmitting element connected to the powered actuator, a holder on which the print head is mounted, a cam track fixed to the frame establishing a path of travel having acceleration and deceleration portions and cam follower means pivotally interconnecting the force transmitting element and the holder in the cam track for constraining movement of the holder along said path of travel during each operational cycle of the powered actuator, the improvement comprising means for dividing the acceleration portion of the travel path into at least two sections along which the cam follower means is sequentially displaced at respectively different velocities and shock absorbing means engageable with the holder along the deceleration portion of the travel path for stabilizing orientation of the print head during approach to the marking position, the shock absorbing means including a guide roller.

2. The improvement as defined in claim 1 wherein one of the sections of the acceleration portion of the travel path is substantially perpendicular to the inking surface and the other of the sections forms more than 50% of the travel path distance.

3. The combination of claim 2 wherein the drive mechanism further includes harmonic means drivingly connecting the powered actuator to the force transmitting element for continuous movement of the print head to and from the marking position.

4. The combination of claim 2 wherein the powered actuator includes a fluid pressure piston device pivotally mounted on the frame and timing means operatively connected to the piston device for determining the duration of the operational cycles.

5. The combination of claim 1 wherein the drive mechanism further includes harmonic means drivingly connecting the powered actuator to the force transmitting element for continuous movement of the print head to and from the marking position.

6. The combination of claim 1 wherein the powered actuator includes a fluid pressure piston device pivotally mounted on the frame and timing means operatively connected to the piston device for determining the duraction of the operational cycles.

7. In an ink marking apparatus including a print head cyclically dispaced between inking and marking positions, powered actuator means operatively connected to the print head for imparting movement thereto between said positions thereof, cam means for constraining said movement of the print head to a path of travel having portions along which the print head undergoes acceleration and deceleration, respectively, means mounting the cam means in operative relation to the actuator means for establishing said acceleration and said deceleration of the print head along the respective portions of the path of travel and resilient guide means engageable with the print head for stabilizing orientation thereof during said movement to the marking position while constrained by the cam means along the deceleration portion of the path of travel.

8. The combination of claim 7 wherein said cam means includes a fixed cam track having separate sections at right angles to angularly related contact planes and a cam follower pivotally connecting the actuator to the print head at a connecting point movable along the travel path.

9. The combination of claim 8 including an ink cartridge having an inking surface, holder means for removably positioning the ink cartridge with the inking surface thereof in alignment with one of the contact planes and target backing means aligned with the other of the contact planes for limiting said movement of the print head to the marking position.

10. In an apparatus for marking a target on a work surface including a frame mounted in operative relation to the work surface, a powered actuator, an ink storing device having a wet inking surface positioned in predetermined spaced relation to the work surface, a print head alternatively engageable with said inking surface and a target on the work surface and a drive mechanism responsive to operation of the powered actuator for displacing and reorientating the print head between inking and marking positions respectively engaging the inking surface and the target, said drive mechanism having a force transmitting element connected to the powered actuator, a holder on which the print head is mounted, a cam track fixed to the frame establishing a path of travel having acceleration and deceleration portions and cam follower means pivotally interconnecting the force transmitting element and the holder in the cam track for constraining movement of the holder along said path of travel during each operational cycle of the powered actuator, the improvement comprising shock absorbing means engageable with the holder only along the deceleration portion of the travel path for stabilizing orientation of the print head during approach to the marking position and positioning means in which the ink storing device is removably mounted for selective displacement of the inking surface from said predetermined spaced relationship to the work surface.

11. The improvement as defined in claim 10 further including means for dividing the acceleration portion of the travel path into at least two sections along which the cam follower means is sequentially displaced at different velocities.

12. In an ink marking apparatus including a print head cyclically displaced between inking and marking positions, powered actuator means operatively connected to the print head for imparting movement thereto between said positions thereof and cam means for constraining said movement of the print head to a path of travel having an acceleration portion and a deceleration portion, the improvement comprising means for dividing the acceleration portion of the path of travel into separate sections which the angularly related to each other and to said deceleration portion, of the travel path.

13. The combination of claim 12 including linkage means drivingly connecting the powered actuator means to the print head for continuous movement thereof to and from the marking position during each operational cycle.

14. The combination of claim 13 wherein the marking position of the print head corresponds to one-half phase of the operational cycle.

* * * * *

UNITED STATES PATENT AND TRADEMARK OFFICE

CERTIFICATE OF CORRECTION

PATENT NO. : 4,760,788

DATED : August 2, 1988

INVENTOR(S) : Alfred A. Marozzi, et al

It is certified that error appears in the above-identified patent and that said Letters Patent is hereby corrected as shown below:

Title page item [57], line 4, cancel "portion", insert --portions--.

Col. 10, line 10, cancel "which the"; line 11, after "portion," insert --the print head traveling at different velocities along said separate sections and means operatively connected to the print head for angular reorientation thereof only during travel along one of the separate sections of the acceleration portion--.

Signed and Sealed this

Third Day of December, 1991

*Attest:*

HARRY F. MANBECK, JR.

*Attesting Officer*

*Commissioner of Patents and Trademarks*